US006129475A

United States Patent [19]

De Beer et al.

[11] Patent Number: 6,129,475

[45] Date of Patent: Oct. 10, 2000

[54] FILING OF DOCUMENTS

[75] Inventors: Eric Rodney De Beer; Klaus Peter Siegmund Mathias, both of Gauteng, South Africa

[73] Assignees: Stuebing Automatic Machine Company, Cincinnati, Ohio; Grip Binders (Proprietary) Limited, Gauteno, South Africa

[21] Appl. No.: 09/222,972

[22] Filed: Dec. 30, 1998

[51] Int. Cl.[7] ..... B42F 13/06

[52] U.S. Cl. ..... 402/14; 402/15

[58] Field of Search ..... 402/60, 61, 62, 402/63, 64, 65, 66, 67, 68, 8, 9, 14, 15, 16, 17, 18, 80 R

[56] References Cited

U.S. PATENT DOCUMENTS

| | | | |
|---|---|---|---|
| 3,970,331 | 7/1976 | Giulie . | |
| 4,285,104 | 8/1981 | Corey et al. | 402/14 |
| 4,305,675 | 12/1981 | Jacinto . | |
| 4,382,708 | 5/1983 | Corey | 402/15 |
| 4,453,851 | 6/1984 | Purcocks . | |
| 5,011,318 | 4/1991 | Gilmore | 402/14 |
| 5,785,444 | 7/1998 | Matsuura | 402/14 X |

FOREIGN PATENT DOCUMENTS

| | | |
|---|---|---|
| 61789 | of 1968 | Germany . |
| 2647044 | 4/1978 | Germany . |
| 3342997 | 6/1985 | Germany . |
| 8402406 | 3/1986 | Netherlands . |
| 8500234 | 8/1986 | Netherlands . |
| 92/4636 | 6/1992 | South Africa . |
| 2224469 | 5/1990 | United Kingdom . |
| 1494316 | 12/1997 | United Kingdom . |
| WO91-04162 | 4/1991 | WIPO . |

*Primary Examiner*—Willmon Fridie, Jr.
*Attorney, Agent, or Firm*—Wood, Herron & Evans, LLP

[57] ABSTRACT

A filing arrangement includes a folder. A pair of filing prongs are fixed to the folder to be received through openings defined in sheets to be filed in the folder. A base member is fastened to an inner surface of the folder. A pair of flexible, elongate elements are arranged on, and extend from, the base member. The elongate elements are displaceable between a first position in which the elongate elements extend upwardly from the base member and a second position in which the elongate elements are substantially parallel to the inner surface of the folder. One engaging member is arranged on a free end of each elongate element and is engageable with a free end of each filing prong. When the elongate elements are in their first position, one engaging member is releasably engageable with the free end of each filing prong.

44 Claims, 10 Drawing Sheets

FILING OF DOCUMENTS

FIELD OF THE INVENTION

THIS INVENTION relates to the filing of documents. More particularly, this invention relates to a filing arrangement, to an accessory for a filing arrangement and to a folder for a filing arrangement.

BROAD DESCRIPTION OF THE INVENTION

According to a first aspect of the invention, there is provided a filing arrangement which includes a folder;

a pair of filing prongs which are fixed to the folder to be received through openings defined in sheets to be filed in the folder;

a base member which is fastened to an inner surface of the folder;

a pair of flexible, elongate elements arranged on, and extending from, the base member, the elongate elements being displaceable between a first position in which the elongate elements extend upwardly from the base member and a second position in which the elongate elements are substantially parallel to the inner surface of the folder; and a pair of engaging members, one engaging member being arranged on a free end of each elongate element and being engageable with a free end of each filing prong, the engaging members being configured so that, when the elongate elements are in their first position, each engaging member of the pair is releasably engageable with the free end of each filing prong to retain the elongate elements in a configuration in which transfer of the sheets from the filing prongs on to the elongate elements is facilitated.

The elongate elements may be arranged on the base member to extend substantially at right angles to a spine of the folder when the elongate elements are in their second position. Instead, the elongate elements may be arranged on the base member to extend substantially parallel to a spine of the folder when the elongate elements are in their second position.

The base member, the elongate elements and the engaging members may be of a plastics material.

The elongate elements may be arranged on the base member to be pivotal with respect to the base member between the first position and the second position.

The base member and the elongate elements may be discrete components.

An attachment means may be arranged on the base member and the elongate elements to permit the elongate elements to be releasably attached to the base member.

The arrangement may include a retaining means for retaining the elongate elements in their first position and in their second position once the elongate elements have been pivoted into their first or second positions. The retaining means may be configured so that the elongate elements can be retained in either the first position or the second position irrespective of the orientation of the base member on the inner surface of the folder.

Instead of being discrete components, the base member and the elongate elements may be of a unitary, one-piece construction. In particular, the base member and the elongate elements may be a one-piece moulding.

A living hinge may be defined between each elongate element and the base member so that the elongate elements are pivotal with respect to the base member. The living hinge may be configured so that the elongate elements are biased into their second position.

The arrangement may include a retaining means for retaining the elongate elements in their first position once the elongate elements have been pivoted into their first position.

Each engaging member may be a socket-defining component which defines a socket which is dimensioned so that the free end of a prong can be received therein. Each socket-defining component may have a substantially rectangular, external transverse profile.

A guide formation may extend from a free end of each socket-defining component.

Each socket-defining component may have a substantially rectangular internal transverse profile with internal dimensions complementary to the free end of its associated filing prong.

A wall of each socket-defining component may have at least one aperture defined therein to enable injection moulding without sliding core members.

The base member may be adhered to the inner surface of the folder. Instead, the base member may be mechanically fastened to the inner surface of the folder. The base member may be rivetted to the folder.

According to a second aspect of the invention, there is provided a filing accessory which includes a base member;

a fastening means which is arranged on the base member to permit the base member to be fastened to an inner surface of the folder;

a pair of flexible elongate elements arranged on, and extending from, the base member; and a pair of engaging members, one engaging member being arranged on a free end of each elongate element and being releasably engageable with an end of a filing prong.

The fastening means may include an adhesive layer arranged on the base member to permit the base member to be adhered to the inner surface of a folder. Instead, the fastening means may include a mechanical fastening arrangement to permit the base member to be mechanically fastened to the folder.

According to a third aspect of the invention, there is provided a folder for a filing arrangement, the folder including a front cover;

a back cover;

a pair of filing prongs extending from an inner surface of one of the covers; and a fastening means arranged on an inner surface of one of the covers for fastening a base member of a filing accessory having a pair of flexible elongate elements arranged on, and extending from, the base member, to the inner surface of said one of the covers, the fastening means and the prongs being positioned relative to each other so that an engaging member arranged on a free end of each elongate element is releasably engageable with an end of each filing prong to retain the elongate elements in a configuration in which transfer of sheets from the filing prongs on to the elongate elements is facilitated.

The prongs may extend from the inner surface of the back cover. The fastening means may be in the form of a layer of adhesive arranged on the inner surface of the front cover so that the base member can be adhered to the inner surface of the front cover.

A cove r strip may be arranged on the layer of adhesive to be removed by a user prior to use.

According t o a fourth aspect of the invention, there is provided a filing arrangement which includes a folder;

a pair of filing prongs which are fixed to the folder to be received through openings defined in sheets to be filed in the folder;

a base member;

a retaining means which is arranged on the base member for retaining the base member in an operative position relative to the prongs;

a pair of flexible, elongate elements which are arranged on the base member; and a pair of engaging members, an engaging member being arranged on a free end of each elongate element and being engageable with a free end of each prong, the elongate elements being configured so that, when the engaging members are engaged with the prongs, the elongate elements are in a configuration in which transfer of the sheets from the prongs on to the elongate elements is facilitated.

The retaining means may include at least one clipping formation which is shaped to clip on to the prongs. In particular, the retaining means may include a pair of clipping formations which are shaped so that a clipping formation can be clipped to each prong.

The base member, the elongate elements and the engaging members may be of a plastics material.

The elongate element s may be arranged on the base member to be displaceable with respect to the base member between a first position in which the elongate elements are substantially perpendicular to an inner surface of the folder and a second position in which the elongate elements are substantially parallel to the inner surface of the folder.

The elongate elements may be arranged on the base member to be pivotal with respect to the base member between the first and second positions.

A living hinge may be defined between each elongate element and the base member. The living hinges may be configured so that the elongate elements are biased into their second position.

The base member and the elongate elements may be discrete components. An attachment means may be arranged on the base member and the elongate elements to permit the elongate elements to be releasably attached to the base member.

Instead, the base member and the elongate elements may be of a unitary, one-piece construction. In particular, the base member and the elongate elements may be a one-piece moulding.

Each engaging member may be a socket-defining component which defines a socket which is dimensioned so that the free end of a prong can be received therein.

Each socket-defining component may have a substantially rectangular, external transverse profile. A guide formation may extend from a free end of each socket-defining component. Each socket-defining component may have a substantially rectangular, internal transverse profile with internal dimensions complementary to the free end of its associated prong.

According to a fifth aspect of the invention, there is provided a filing accessory which includes a base member;

a retaining means which is arranged on the base member for retaining the base member in an operative position relative to a pair of prongs extending from an inner surface of a folder;

a pair of flexible, elongate elements which are arranged on the base member; and a pair of engaging members, an engaging member being arranged on one end of each elongate element and being engageable with a free end of each prong, the elongate elements being configured so that the elongate elements can be retained in an arch-like configuration.

The invention is now described, by way of examples, with reference to the accompanying drawings.

DETAILED DESCRIPTION OF THE DRAWINGS

Figure 1:
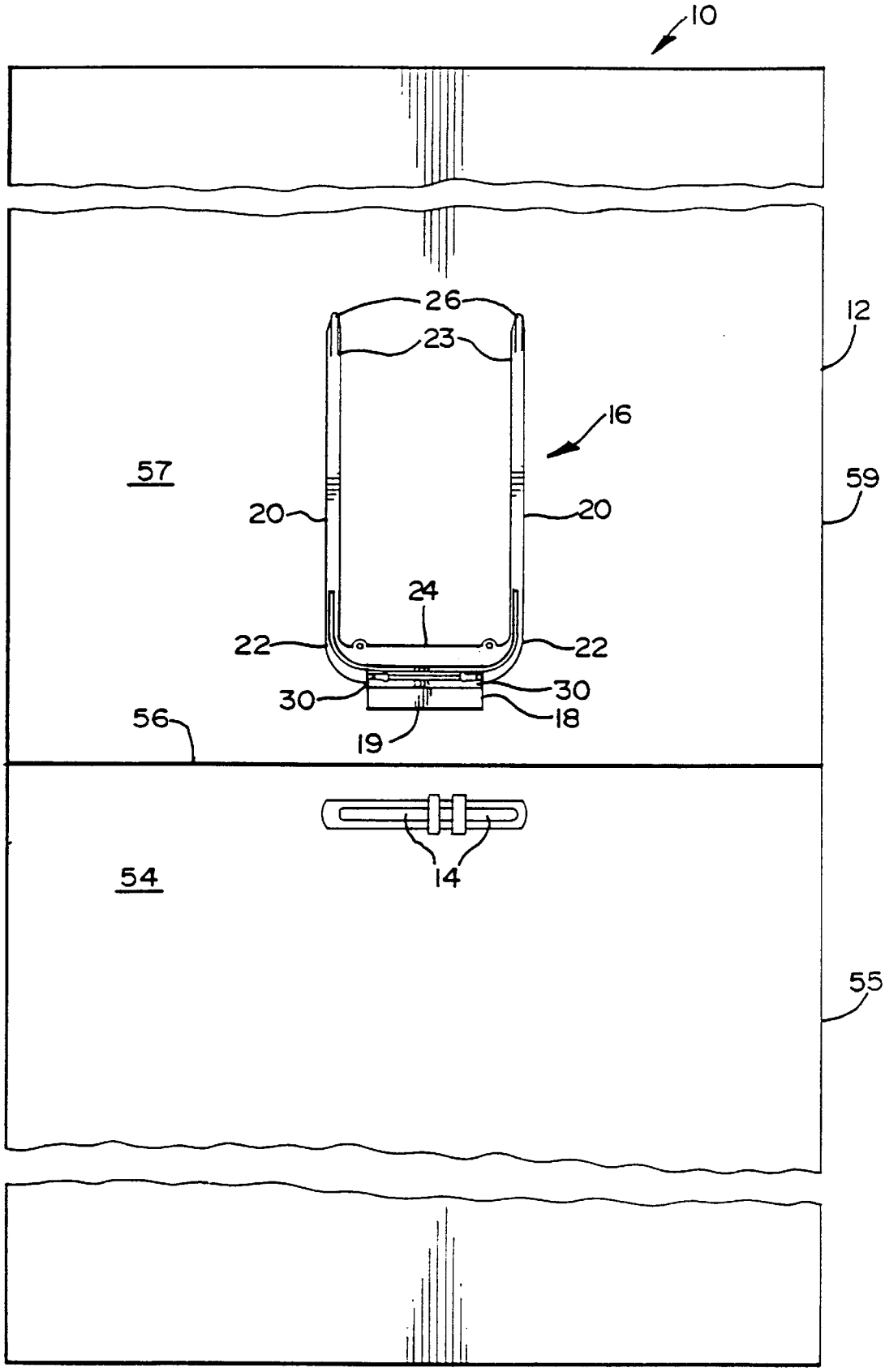
FIG. 1 shows a schematic plan view of a filing arrangement, in accordance with a first aspect of the invention.

In FIG. 1, reference numeral 10 generally indicates a filing arrangement in accordance with the invention.

The filing arrangement 10 includes a folder 12. A pair of metal prongs 14, shown in a folded-down position, are fixed to the folder 12, to be received through openings defined in sheets (not shown) to be filed in the folder 12.

The arrangement 10 includes a filing accessory 16 in accordance with a second aspect of the invention.

The filing accessory 16 includes a base member or base 18. The accessory 16 also includes a pair of elongate elements, or arms 20 which are interconnected, at one end 22, via a cross-member or bridge 24, to be substantially "U-shaped". The base 18, the bridge 24 and the arms 20 are of a resiliently flexible, plastics material.

An opposed end 23 of each arm 20 has a socket-defining component 26 arranged thereon which defines a socket 28 which is dimensioned so that an end (not shown) of one prong 14 is receivable in the socket 28 to be held in the socket 28.

In use, the bridge 24 and the arms 20 are pivotally mounted on the base 18. The prongs 14 are attached to an inner surface 54 of a back cover 55 of the folder 12 on one side of a spine 56 of the folder 12. The base 18 is, in use, attached to an inner surface 57 of a front cover 59 of the folder 12 on an opposed side of the spine 56. The base 18 is positioned relative to the prongs 14 so that the arms 20, when connected to the prongs 14, form a smooth, self-supporting arch conducive to the transfer of sheets.

The arms 20 are pivotal into a first position in which the arms 20 are oriented at about 900 relative to the inner surface 54. From this position, the arms 20 can be bent so that the ends of the prongs 14 can be received in the sockets 28. Thus, any sheets which are positioned on the prongs 14 can be transferred from the prongs 14 onto the arms 20 to facilitate removal, addition and replacement of sheets while retaining the original sequence of sheets.

The arms 20 are pivotal from the first position into a second position, in which they are located adjacent the inner surface 57.

A pair of adhesive strips 17 are fixed to the base 18 to permit the base 18 to be adhered to the inner surface 57 of the front cover 59.

Figure 4:
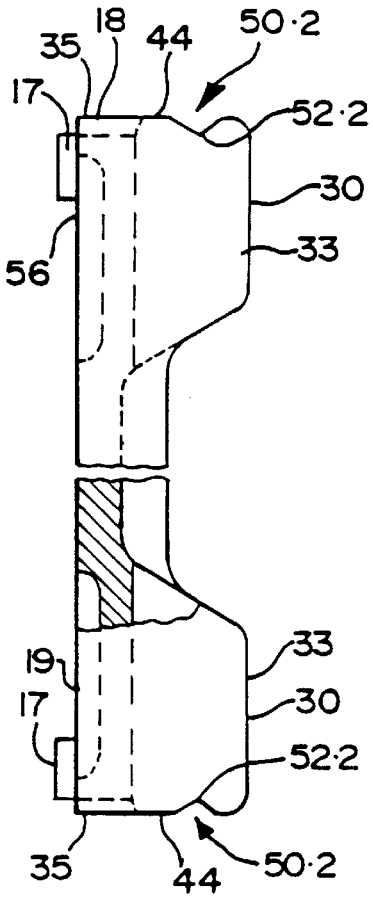
FIG. 4 shows a partly sectioned front view of a base member of the first embodiment of the accessory.
Figure 2:
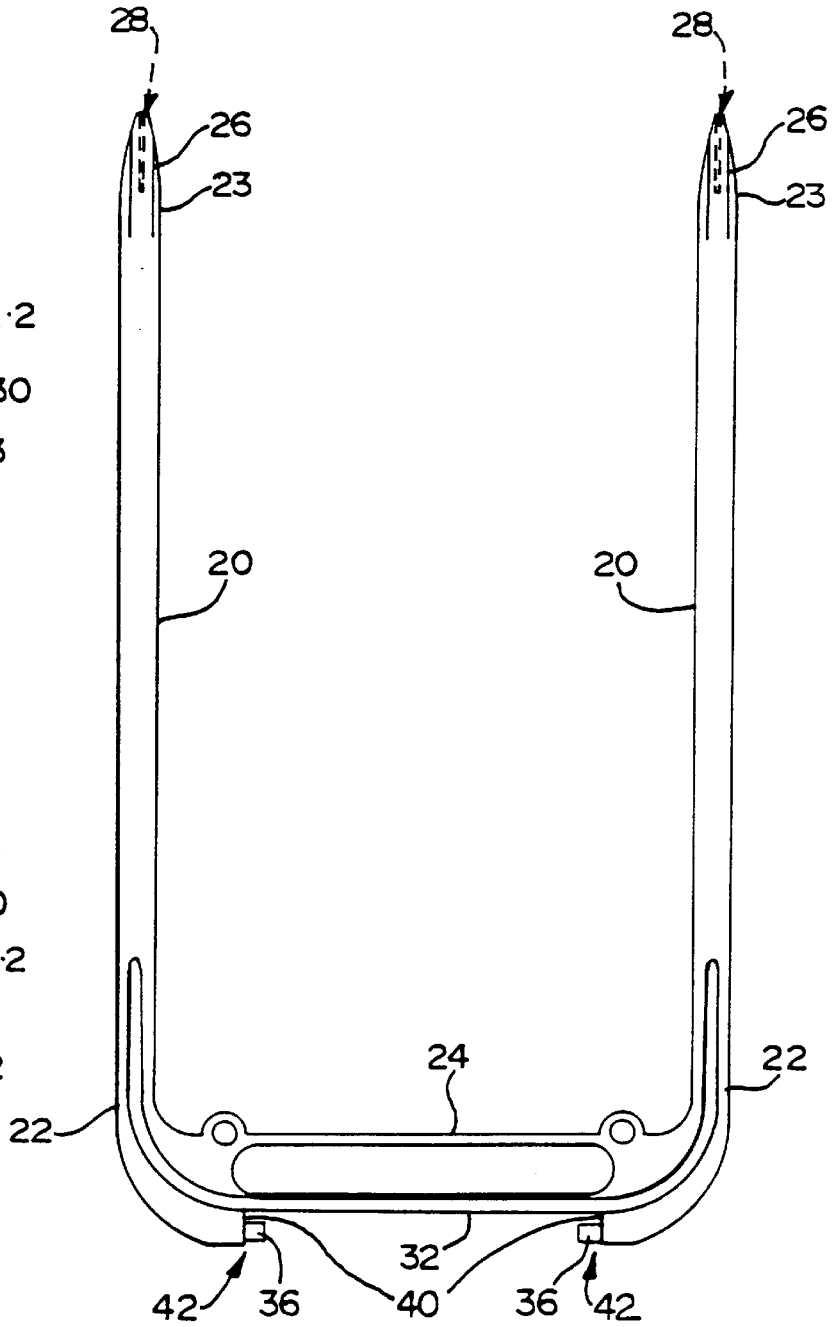
FIG. 2 shows a front view of a pair of elongate elements of a first embodiment of a filing accessory in accordance with a second aspect of the arrangement.
Figure 3:
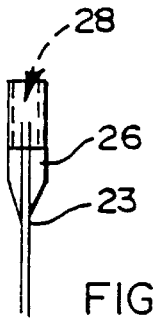
FIG. 3 shows a side view of an example of a socketdefining component of the accessory of FIG. 2.

The base 18 (FIG. 4) includes a base plate 19. The plate 19 has a retaining means in the form of a pair of spaced, part-circular clips 30 extending therefrom. Each clip 30 (FIG. 6) defines a channel 31 having an internal, part-circular transverse profile which opens operatively upwardly. Each channel 31 is defined by a pair of curved walls 33, which are resiliently displaceable away from each other to permit an article to be urged into the channel 31. The clips 30 are positioned on opposed ends 35 of the plate 19 and are coaxial.

The bridge 24 has a pair of spaced spigot pins 36 which are of circular cross section and coaxial and are positioned on a lower side 32 of the bridge 24, to be spaced from each other and from the lower side 32, and to extend towards each other. The clips 30 and the spigot pins 36 are positioned relative to each other so that each pin 36 can be retained in a clip 30. In use, the bridge 24 is urged downwardly so that each pin 36 serves to urge a pair of walls 33 apart to permit the pin 36 to be received in its associated channel 31. It will be appreciated that the orientation of the clips 30 and the pins 36 relative to each other permits pivotal movement of the arms 20 relative to the base 18.

The lower side 32 of the bridge 24 defines a pair of faces 40 which are directed towards each other. Each pin 36 extends from one face 40 to define a shoulder 42 between each pin 36 and its associated face 40. The faces 40 are positioned so that, when the pins 36 are in position, each face 40 abuts a complementary face 44 of its associated clip 30.

Each face 40 has a wedge shaped projection or tooth formation 46 extending therefrom. The formation 46 is positioned on each face 40 so that a vertex 48 defined by the formation 46 is parallel to the arms 20.

Figure 5:
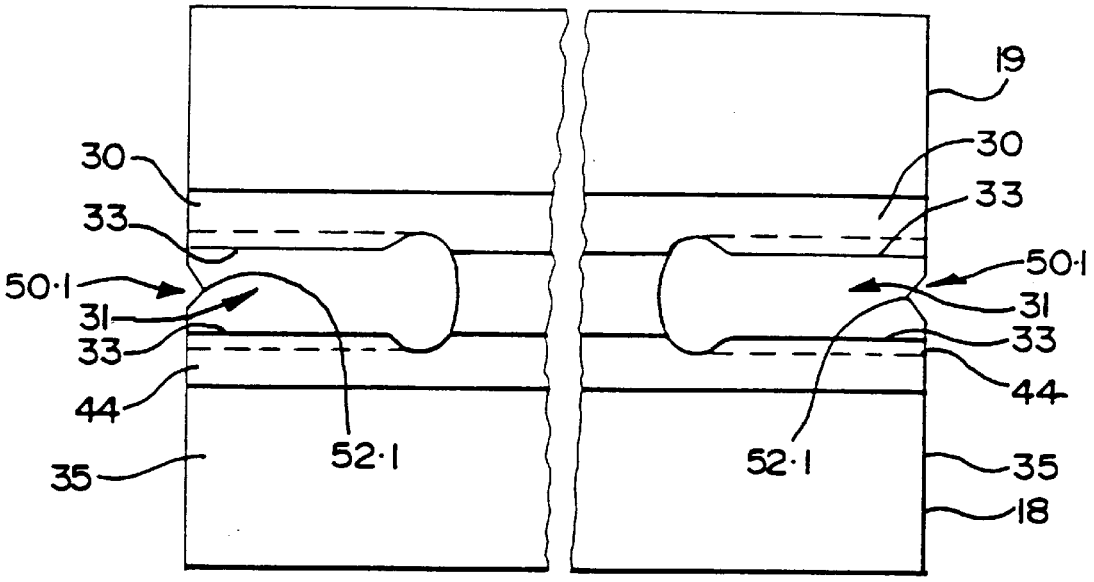
FIG. 5 shows a plan view of the base member of FIG. 4.
Figure 6:
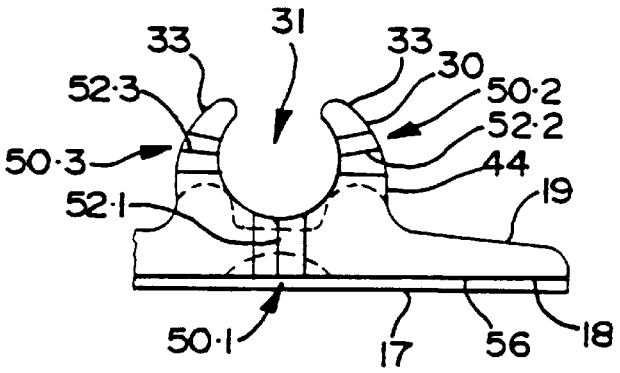
FIG. 6 shows an end view of the base member of FIG. 4.
Figure 8:
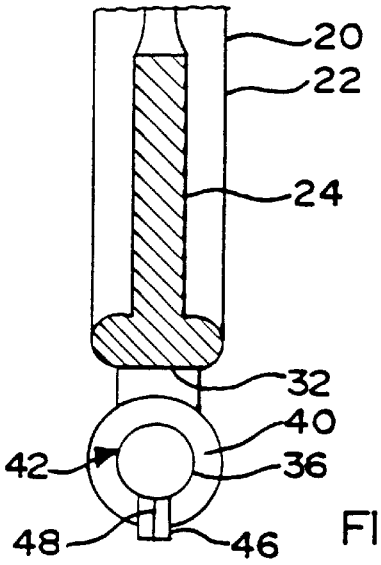
FIG. 8 shows a sectioned side view of the elongate elements of the accessory of FIG. 2.
Figure 7:
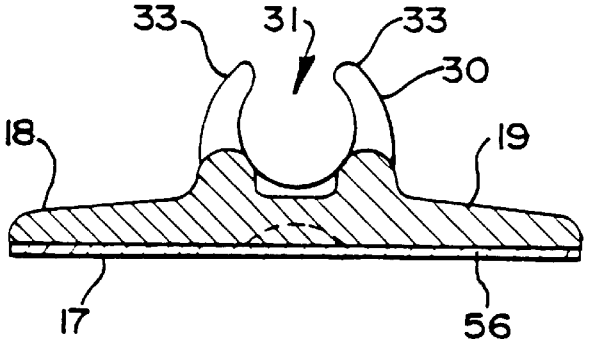
FIG. 7 shows a sectioned side view of the base member of FIG. 4.
Figure 9:
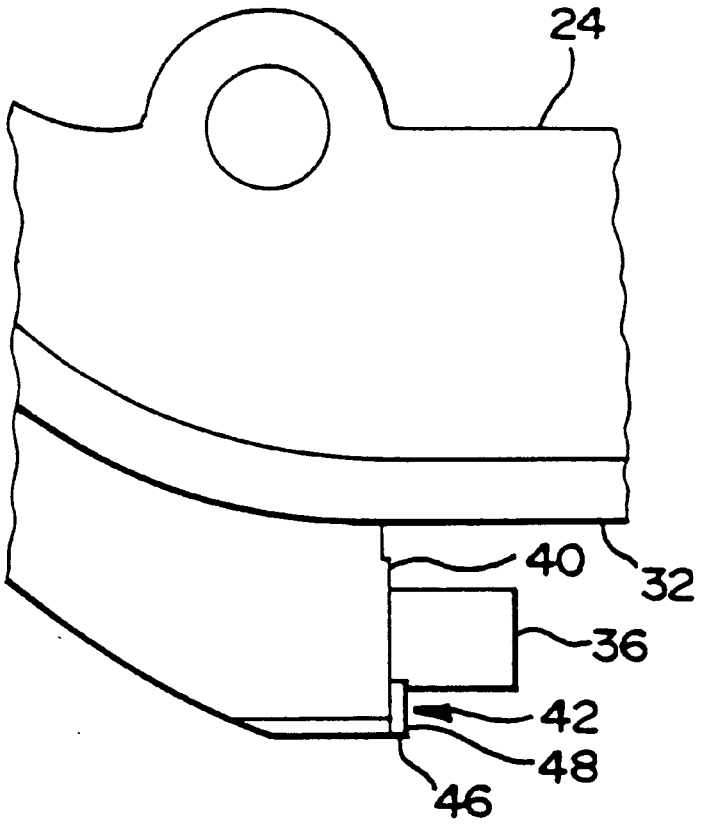
FIG. 9 shows a front view of part of a bridge of the accessory of FIG. 2.
Figure 10:
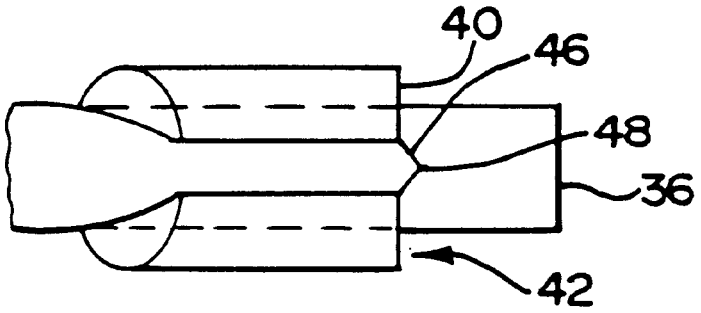
FIG. 10 shows a bottom view of part of the bridge of FIG. 9.

Each complementary face 44 of the clips 30 has three wedge-shaped recesses 50 defined therein (FIGS. 5 and 6).

The distance between the faces 40 is substantially equal to the distance between the complementary faces 44. Thus, when the spigot pins 36 are clipped into the clips 30, each face 40 will bear against a complementary face 44. It will be appreciated that the projections 46 and the recesses 50 serve to retain the arms 20 in certain positions.

A vertex 52.1 of one of the recesses 50.1 on each face 44 is oriented at about 90° to the inner surface 54 of the folder 12, in use. Thus, when the formations 46 are received in the recesses 50.1, the arms 20 are retained in the first position. Another recess 50.2 on each face 44 has a vertex 52.2 which is positioned so that, when the formations 46 are received within the recesses 50.2, the arms 20 are held in their second position. A further recess 50.3 on each face 44 is positioned to be diametrically opposed to the recess 50.2 and has a vertex 52.3. Thus, even if, on assembly by a user, the base 18 is rotated through 180° on the front cover 59, the arms 20 can still be retained in their second position. This facilitates adhesive fixing of the base 18 to the cover 59.

The arms 20, the bridge 24 and the spigot pins 36 are of a unitary, one-piece moulding. The base 18 is also of a unitary, one-piece moulding.

The resilience of the material permits a user to remove the arms 20 from the base 18 by simply pulling the arms 20 away from the base 18. This causes the pins 36 to act against the walls 33 to displace the walls 33 away from each other, so that the pins 36 can be withdrawn from the channels 31.

Each component 26 has a rectangular, external transverse profile. Further, each component 26 has a rectangular, internal transverse profile, with internal dimensions complementary to the end of its associated prong 14. It will be appreciated that this, together with the fact that the components 26 are of a resiliently flexible, plastics material facilitates gripping of each prong 14 by the components 26.

It will be appreciated that the positioning of the accessory 16 relative to the prongs 14 is important. Thus, the accessory 16 can be supplied together with a template (not shown) which can be positioned on the binder of the combination to facilitate optimal positioning of the base 19 on the cover 59.

Figure 11:
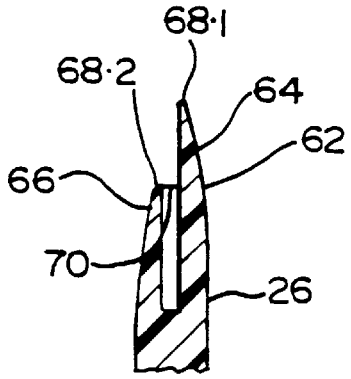
FIG. 11 shows a sectioned side view of a further example of a socket-defining component of the accessory.

A further example of the socket-defining component 26 is shown in FIG. 11. In this example, the component 26 is provided with a guide formation 62 which is defined by a portion 64 of the component 26. It will be appreciated that an end 66 of the component 26 has a pair of opposed longer edges 68 and a pair of opposed shorter edges 70. The portion 64 defining the guide formation 62 has one of the longer edges 68.1 which extends beyond the other longer edge 68.2. Thus, insertion of a prong 14 into each component 26 is facilitated.

Figure 12:
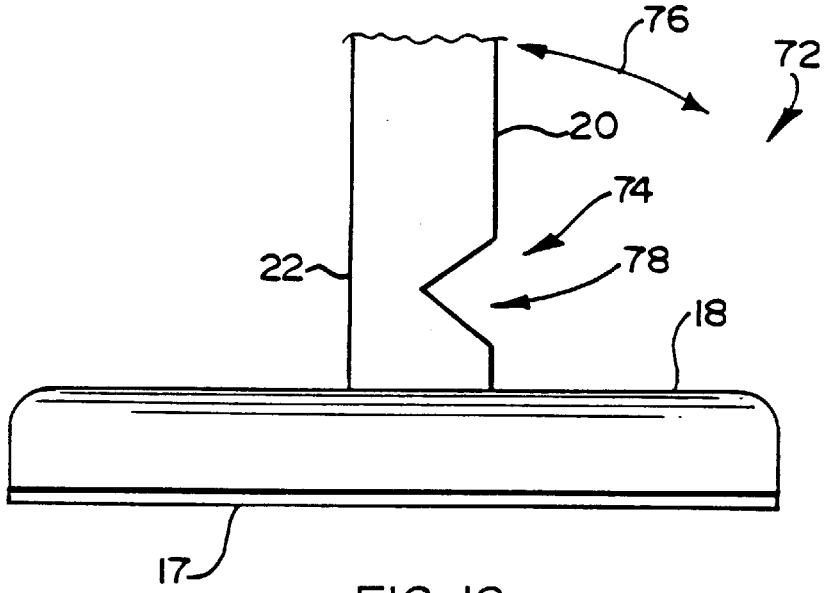
FIG. 12 shows a side view of part of a second embodiment of the accessory incorporating a living hinge.

In FIG. 12, reference numeral 72 generally indicates a second embodiment of part of an accessory for a filing arrangement. With reference to FIGS. 1 to 11, like numerals refer to like parts, unless otherwise specified.

Instead of the bridge 24 and the associated components, the base 18 and the arms 20 are of a one-piece moulding. A living hinge 74 is defined at the end 22 of each arm 20 to provide pivotal movement in the directions indicated by the arrow 76. Each living hinge 74 is formed by a region 78 of reduced thickness. Each living hinge 74 is configured so that the arms 20 are biased into their second position.

Figure 13:
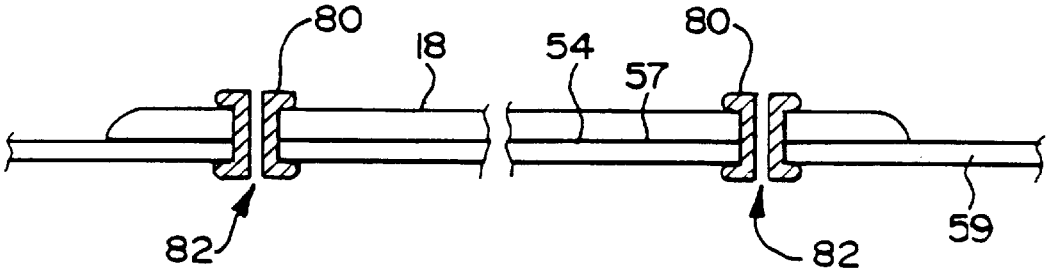
FIG. 13 shows a partly sectioned view of a base member of any embodiment of the accessory mechanically fastened to an inner surface of a folder.

In FIG. 13, there is shown the base 18 secured to the front cover 57 of the folder 12 via a pair of rivets 80. The rivets 80 are received through openings 82 defined in the base 18 and in the folder 12.

Figure 14:
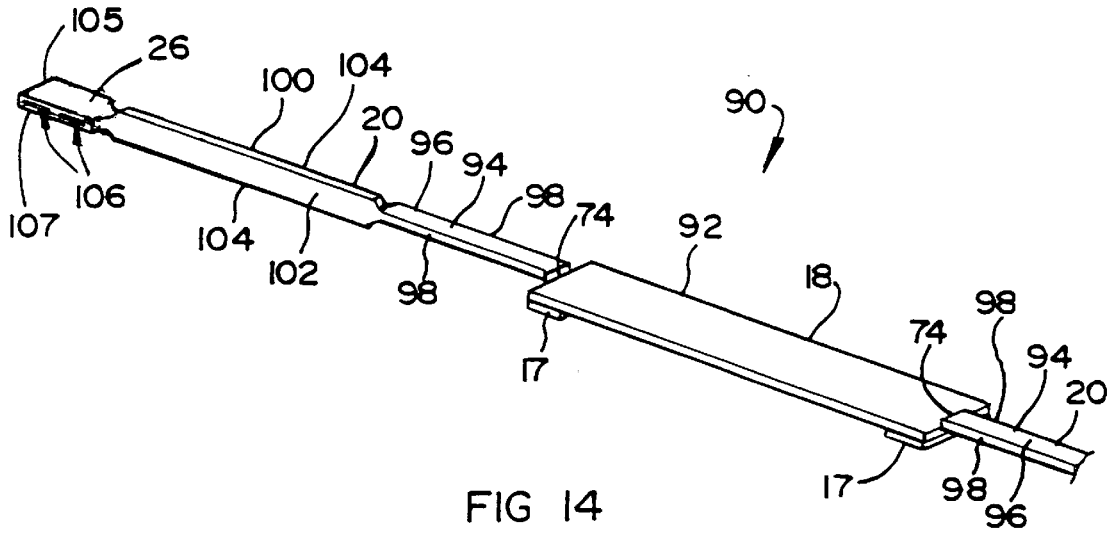
FIG. 14 shows a three dimensional view of a third embodiment of the filing accessory.
Figure 15:
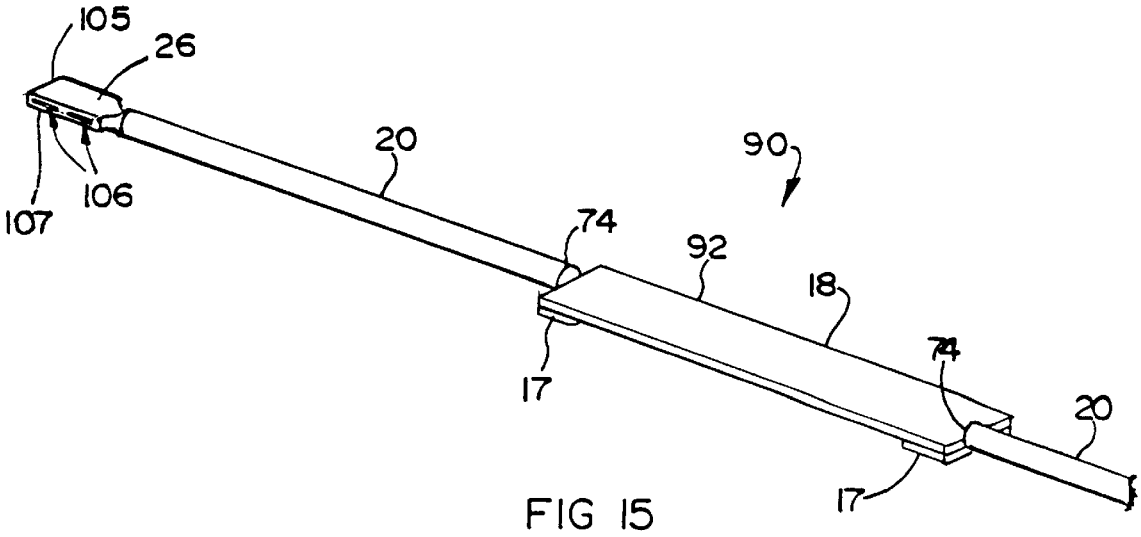
FIG. 15 shows a three dimensional view of a fourth embodiment of the filing accessory.

In FIGS. 14 and 15, reference numeral 90 generally indicates a third and fourth embodiment, respectively, of a filing accessory, in accordance with the invention. With reference to FIGS. 1 to 13, like numerals refer to like parts, unless otherwise specified.

The arms 20 of the accessory 90 are parallel to the spine 56 of the folder 12 when the accessory 90 is fastened to the folder 12. Thus, the accessory 90 is defined by a moulded length 92 of plastics material. It follows that a plurality of the accessories 90 can be moulded in a side-by-side manner to minimise wastage of mould space.

Each arm 20 is connected to the base 18 via a living hinge 74.

In FIG. 14, each arm 20 has an inner portion 94 which is connected to the base 18. Each inner portion 94 has a flat, rectangular profile so that the inner portion 94 has a pair of opposed, broad sides 96 and a pair of opposed narrow sides 98. Each inner portion 94 is oriented so that, when the arms 20 are in their second position, one of the broad sides 96 of each inner portion 94 is positioned adjacent the inner surface 54 of the folder 12.

Each arm 20 has an outer portion 100 which extends from the inner portion 94. Each outer portion 100 has a flat, rectangular profile so that the outer portion 100 has a pair of opposed broad sides 102 and a pair of opposed narrow sides 104. Each outer portion 100 is oriented so that, when the arms 20 are in their second position, one of the narrow sides 104 of each outer portion 100 is positioned adjacent the inner surface 54 of the folder 12.

It will be appreciated that bending of the inner portions 94 in a plane at right angles to the spine 56 is inhibited while bending of the outer portions 100 in the same plane is facilitated. It follows that, when the arms 20 are in their first position, movement of the sheets over the inner portions 94 is facilitated.

Further, the relative orientations of the inner portions 94 and the outer portions 100 facilitate the correct orientation of the components 26 for insertion of the prongs 14.

Instead of the inner and outer portions 94, 100, the accessory 90 can have arms 20 with a circular cross section (FIG. 15). This also facilitates correct orientation of the components 26.

The accessory 90 can also include the retaining means which is in the form of a clipping formation (not shown). The clipping formation is configured to retain the arms 20 of the accessory 90 in their first position.

Each socket-defining component 26 has a pair of broader walls 105 and a pair of narrower walls 107. A pair of opposed, off-set apertures 106 is defined in each narrower wall 107. The pairs of apertures 106 are off-set relative to each other. Those skilled in the art of moulding plastics will appreciate that this facilitates moulding of the socket-defining components 26. In particular, the apertures 106 dispense with the need for sliding core members in the moulding process.

Figure 16:
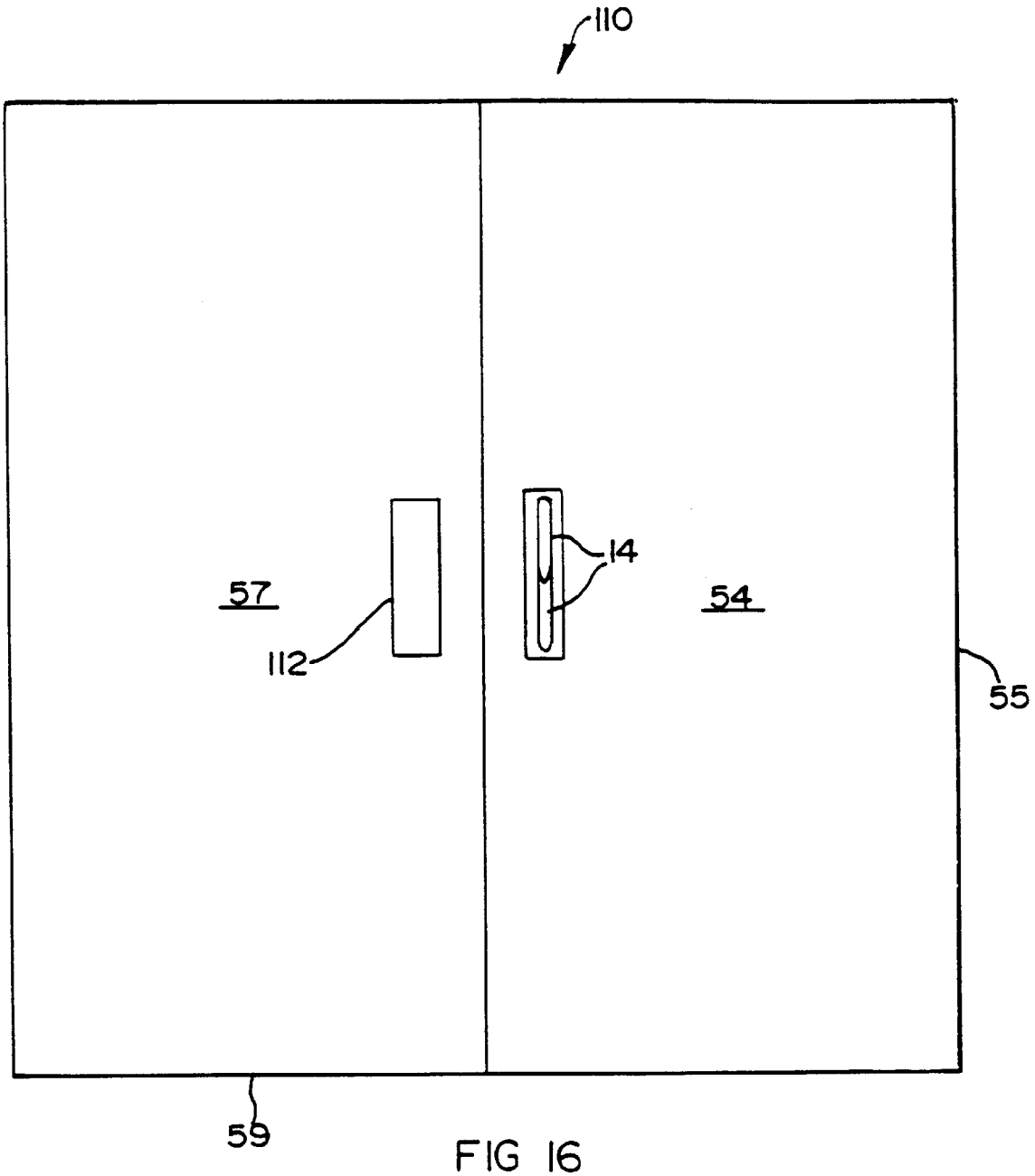
FIG. 16 shows a plan view of a folder, in accordance with a third aspect of the invention, for a filing arrangement.

In FIG. 16, reference numeral 110 generally indicates a folder, in accordance with a third aspect of the invention, for a filing arrangement. With reference to FIGS. 1 to 15, like numerals refer to like parts, unless otherwise specified.

The folder 110 includes the filing prongs 14 extending from the inner surface 54 of the back cover 55. The folder 110 also includes an adhesive fastener 112 which is positioned on the inner surface 57 of the front cover 59 of the folder 110.

Figure 17:
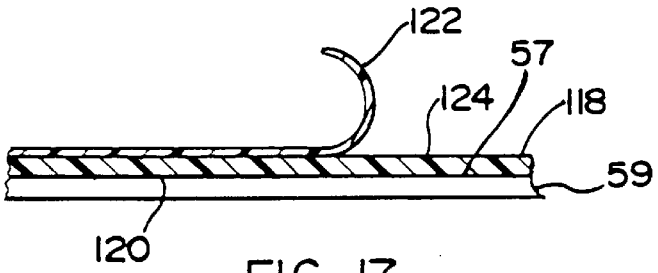
FIG. 17 shows a sectioned side view of a fastening means of the folder.

The fastener 112 comprises an adhesive layer 118 (FIG. 17) which is attached to the inner surface 57 of the front cover 59 on one side 120 of the adhesive layer 118. A cover strip 122 is attached to an opposed side 124 of the adhesive layer 118 to be removed prior to use.

In use, a base member of a filing accessory (not shown) having a pair of flexible elongate elements arranged on, and extending from, the base member, is adhered to the side 124 of the adhesive layer 118 once the cover strip has been removed. The fastener 112 is positioned relative to the prongs 14 so that an engaging member arranged on a free end of each elongate element is releasably engageable with an end of each filing prong 14 to retain the elongate elements in a configuration in which transfer of sheets from the filing prongs on to the elongate elements is facilitated. The folder 110 is supplied separately from the accessory. It follows that storage space can be efficiently utilised due to the fact that only the prongs 14 and the fastener 112 are in the folder 110.

It will be appreciated that the folder 110, when used with the accessory, will be transformed into a file which can be used in a similar manner as a ring or arch-type binder. Thus, the pages can be transferred from the back cover 55 to the front cover 59 and vice-versa, book-fashion. Furthermore, removal of sheets from the folder 110 (for example, to copy or to telefax) and subsequent re-insertion, while retaining the original sequence of the sheets, is facilitated.

The Applicant believes that the invention provides a filing arrangement which combines the filing advantages of a file such as a file having a ring or arch-type mechanism together with the space-saving advantages and low cost of a flat manilla or kraft-type folder.

One of the reasons for this is that, when the arms 20 are bent to engage their associated prongs, they define a self-supporting arch along which sheets can be transferred smoothly. This self-supporting arch arises since the base 18 is fixed to the inner surface 57 of the front cover 59. Smooth transfer is further facilitated by the manner in which the components 26 engage the ends of the prongs 14. Once a desired position in a stack of sheets is found, a user simply pulls the components 26 off their respective prongs 14 and removes and/or adds sheets.

The fact that the sheets are always either on the prongs 14 or the arms 20, effectively removes the problems associated with alignment of sheets prior to replacing the sheets on the prongs 14.

When not in use, the arms 20 can be pivoted into their second position. The dimensions of the arms 20 are such that, when in the second position, the thickness of the folder is determined largely by the thickness of the stack of sheets. It will be appreciated, therefore, that the invention provides a significant advantage with regard to utilisation of storage space, over a standard ring or arch-type mechanism file and the like.

The cost of manufacturing the arrangement 10 will be substantially less than the present cost of manufacturing a ring or arch-type mechanism file. Since such files are often not used to their full capacity, excessive cost and inefficient space utilisation result. Thus, the cost of manufacturing the arrangement 10 and the space-saving features explained above are particularly advantageous.

The fact that the base 18 is secured to the front cover 59 also imparts stability to the arms 20 during transfer of sheets. Control and ease of transfer of sheets as well as retrieval or addition of sheets is facilitated.

Where the bridge 24 and the arms 20 are detachable from the base 18, the bridge 24 and the arms 20 can be used with a number of different folders, each supplied with the base 18.

In FIGS. 18 to 22, reference numeral 130 generally indicates a filing arrangement, in accordance with a fourth aspect of the invention, having a first embodiment of an accessory 132, in accordance with a fifth aspect of the invention, for the filing arrangement. With reference to FIGS. 1 to 17, like numerals refer to like parts, unless otherwise specified.

The folder 12 of the arrangement 130 has a pair of filing prongs 14 positioned proximate an upper edge 134 of the back cover 55 of the folder 12. Thus, the arrangement 130 is particularly suitable where filing of sheets 136 takes place at a position proximate an upper edge 138 of each sheet 136.

Figure 18:
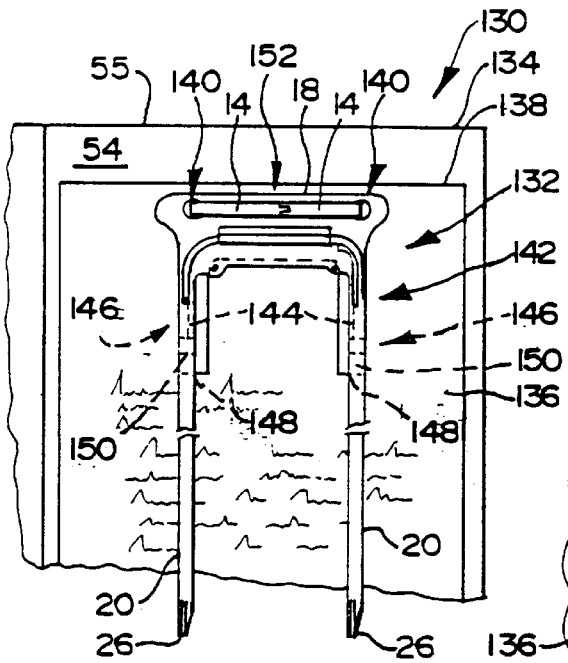
FIG. 18 shows a plan view of a filing arrangement in accordance with a fourth aspect of the invention, with a first embodiment of an accessory, in accordance with a fifth aspect of the invention, of the filing arrangement, in a stored condition.
Figure 19:
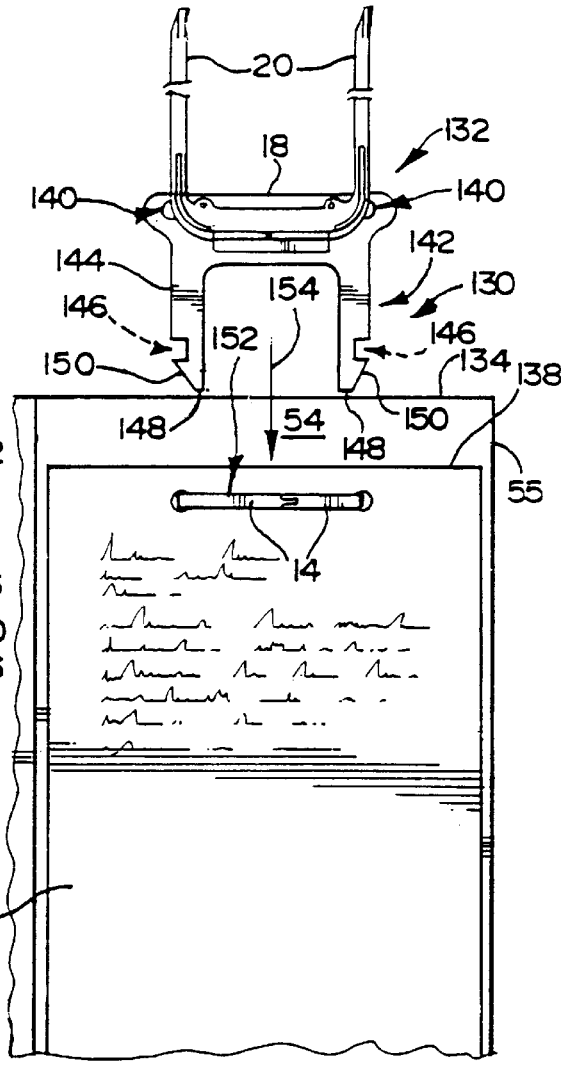
FIG. 19 shows a plan view of the filing arrangement of FIG. 18 with the accessory of the filing arrangement in a condition prior to being positioned for use.

In FIG. 18, the accessory 132 is shown in a stored condition. The base 18 has a pair of openings 140 defined therein. The openings 140 are positioned and dimensioned so that a prong 14 is received through each opening 140. Thus, when the accessory 132 is not in use, the accessory 132 can be stored by placing the base 18 in the position shown in FIG. 18 with the prongs 14 received through the openings 140. The prongs 14 are then bent to lie over the base 18. It follows that, in this position, the base 18 serves as a sheet compressor.

The accessory 132 includes a positioning means in the form of a clipping formation 142 for clipping the base 18 on to the prongs 14. The clipping formation 142 includes a pair of clipping members or clips 144 which extend from the base 18. Each clip 144 has an outwardly opening recess 146 defined therein. The recesses 146 are dimensioned so that a prong 14 can be received in each recess 146. An end 148 of each clip 124 has a chamfered portion 150 defined thereon. The clips 144 are positioned on the base 18 so that, when the clips 144 are urged into a zone 152 in the direction of an arrow 154 (FIG. 19), between the prongs 14, the clips 144 are urged together as a result of the chamfered portions 150.

Figure 20:
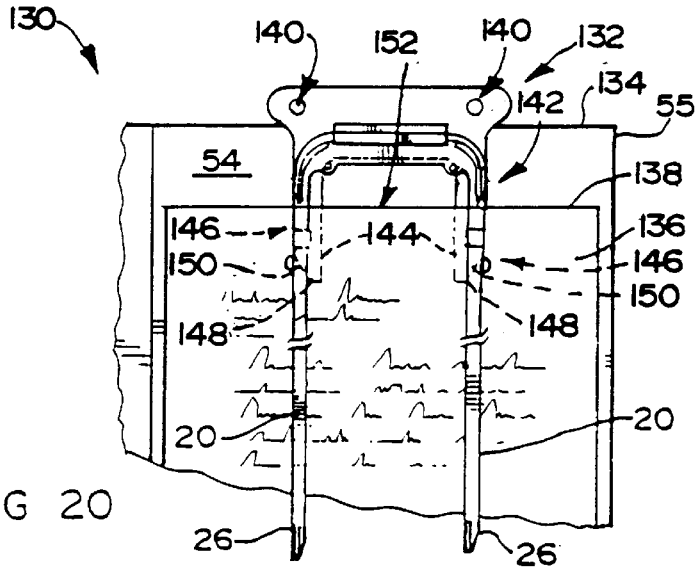
FIG. 20 shows a plan view of the filing arrangement of FIG. 18 with the accessory of the filing arrangement in a preuse condition.

As shown in FIG. 20, the recesses 146 are positioned so that, as the clips 144 are urged into the zone 152, the clips 144 move to their original position so that the prongs 14 are received in the recesses 146. The clips 144 and the base 18 are thus held in position with respect to the prongs 14. The clips 144 and the recesses 146 are such that the base 18 is positioned a distance from the prongs 14 which is such that the arms 20 can be bent over and the socket-defining components 26 can be positioned on the prongs 14 in the manner described above.

Figure 21:
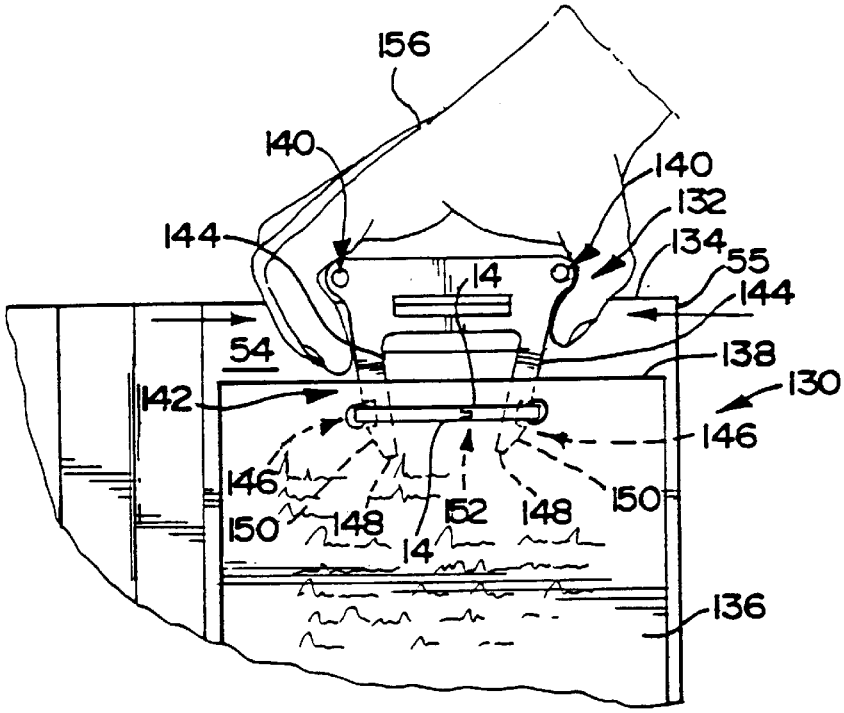
FIG. 21 shows a first step in the removal of the accessory from a folder of the filing arrangement of FIG. 18.
Figure 22:
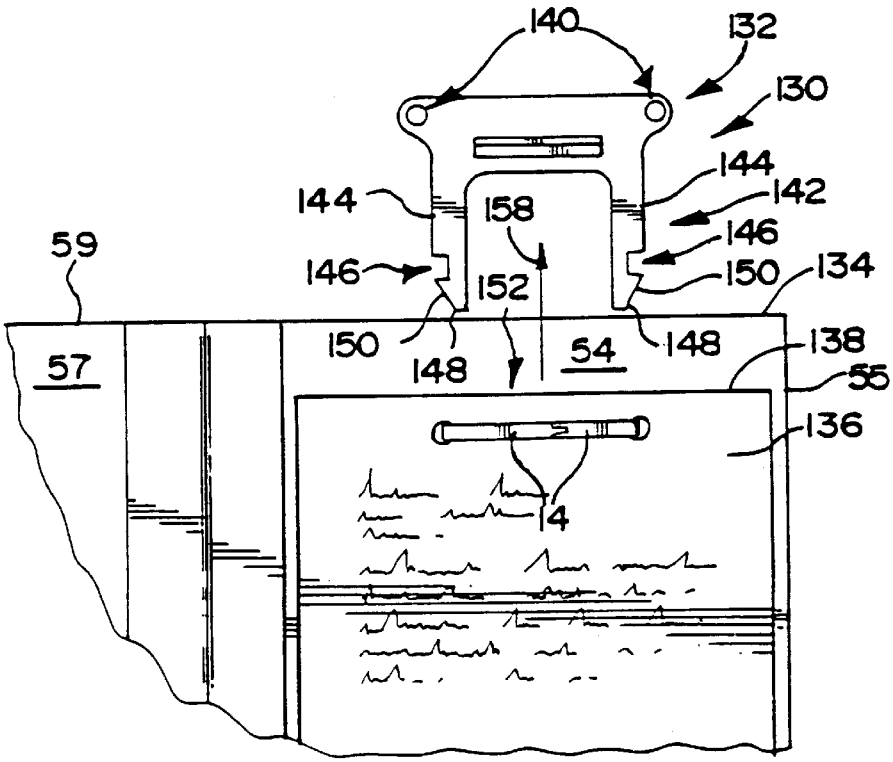
FIG. 22 shows a plan view of the filing arrangement of FIG. 18 with the accessory of the filing arrangement removed from the folder of the filing arrangement.

In FIG. 21 there is shown a first step in the removal of the clips 144 from the prongs 14. A user, whose hand is indicated at 156, urges the clips 144 towards each other until the prongs 14 are out of the recesses 146. The accessory 132 can then be withdrawn from the zone 152 in the direction of an arrow 158 in FIG. 22.

Figure 23:
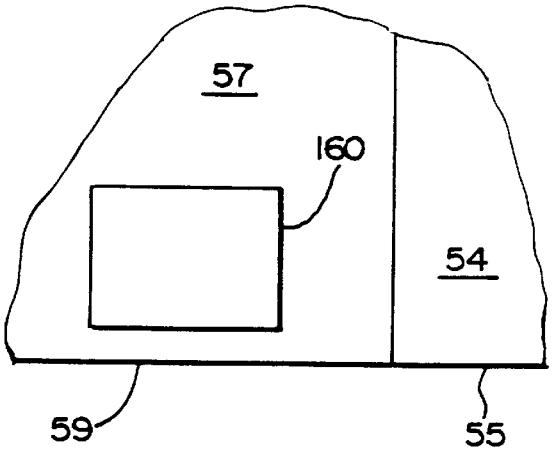
FIG. 23 shows a plan view of a pocket of the filing arrangement of FIG. 18, in which the accessory can be stored.

The accessory 132 can then be stored in the manner shown in FIG. 18, as described above, or placed in a pocket 160 fixed to the inner surface 57 of the front cover 59 of the folder 12 (FIG. 23).

Figure 24:
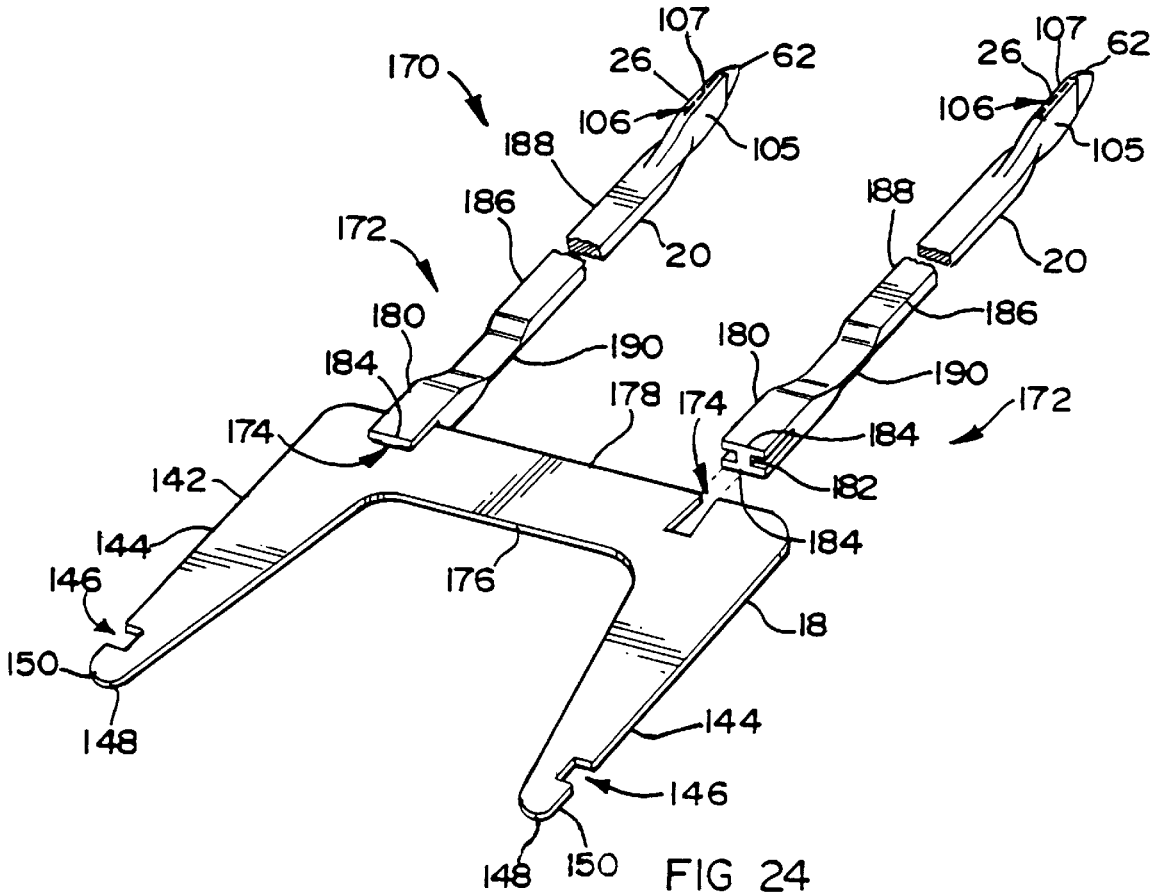
FIG. 24 shows a three dimensional view of a second embodiment of the filing accessory of the fifth aspect of the invention.

In FIG. 24, reference numeral 170 generally indicates a second embodiment of an accessory in accordance with the fifth aspect of the invention. With reference to FIGS. 1 to 23, like numerals refer to like parts, unless otherwise specified.

The accessory 170 has an attachment means 172 for attaching each arm 20 separately to the base 18. The base 18 and the clips 144 are in the form of a flat, one-piece component with the clips 144 extending from one edge 176 of the base 18.

The attachment means 172 includes a pair of spaced slots 174 which are defined in an opposed edge 178 of the base 18. Each arm 20 has a base portion 180. Each base portion 180 has a bridging portion 182 and a pair of opposed end portions 184 which are positioned at right angles to the bridging portion 182 to define an I-shaped, transverse profile. To attach the arms 20 to the base 18, a bridging portion 182 is urged into each slot 174. The bridging portions 182 and the slots 174 are dimensioned so that the arms 20 are retained in position on the base 18.

A remaining portion 186 of each arm 20 is in the form of a flat strip 188. A living hinge 190 is defined in each arm 20 proximate the base portion 180. This facilitates bending of each arm 20 towards the prongs 14.

It will readily be appreciated that the base 18 and the arms 20 can be in the form of a one-piece moulding.

The accessory 132, 170 is used with the folder 12 in which filing of the sheets 136 takes place at a position proximate an upper edge 138 of each sheet 136. The applicant believes that, as with the arrangement 10, the arms 20 are retained in a stable position as a result of the base 18 being secured to the prongs 14. This facilitates smooth transfer of the sheets 136 from the prongs 14 to a position in which the sheets 136 rest on the base 18.

What is claimed is:

1. A filing arrangement which includes a folder;

a pair of filing prongs which are fixed to the folder to be received through openings defined in sheets to be filed in the folder;

a base member which is fastened to an inner surface of the folder;

a pair of flexible elongate elements arranged on, and extending from, the base member, the elongate elements being displaceable between a first position in which the elongate elements extend upwardly from the base member and a second position in which the elongate elements are substantially parallel to the inner surface of the folder;

a pair of engaging members, one engaging member being arranged on a free end of each elongate element and being engageable with a free end of each prong, the engaging members being configured so that, when the elongate elements are in their first position, one engaging member is releasably engageable with the free end of each prong to retain the elongate elements in a configuration in which the transfer of the sheets from the prongs on to the elongate elements is facilitated.

2. The arrangement as claimed in claim 1, in which the elongate elements are arranged on the base member to extend substantially at right angles to a spine of the folder when the elongate elements are in their second position.

3. The arrangement as claimed in claim 1, in which the elongate elements are arranged on the base member to extend substantially parallel to a spine of the folder when the elongate elements are in their second position.

4. The arrangement as claimed in claim 1, in which the base member, the elongate elements and the engaging members are of a plastics material.

5. The arrangement as claimed in claim 1, in which the elongate elements are arranged on the base member to be pivotal with respect to the base member between the first position and the second position.

6. The arrangement as claimed in claim 1, in which the base member and the elongate elements are discrete components.

7. The arrangement as claimed in claim 6, in which an attachment means is arranged on the base member and the elongate elements to permit the elongate elements to be releasably attached to the base member.

8. The arrangement as claimed in claim 6, which includes a retaining means for retaining the elongate elements in their first position and in their second position once the elongate elements have been pivoted into their first or second positions.

9. The arrangement as claimed in claim 4, in which the base member and the elongate elements are of a unitary, one-piece construction.

10. The arrangement as claimed in claim 9, in which the base member and the elongate elements are a one-piece moulding.

11. The arrangement as claimed in claim 9 or 10, in which a living hinge is defined between each elongate element and the base member so that the elongate elements are pivotal with respect to the base member.

12. The arrangement as claimed in claim 11, in which the living hinge is configured so that the elongate elements are biased into their second position.

13. The arrangement as claimed in claim 12, which includes a retaining means for retaining the elongate elements in their first position once the elongate elements have been pivoted into their first position.

14. The arrangement as claimed in claim 1, in which each engaging member is a socket-defining component which defines a socket which is dimensioned so that the free end of a prong can be received therein.

15. The arrangement as claimed in claim 14, in which each socket-defining component has a substantially rectangular, external transverse profile.

16. The arrangement as claimed in claim 15, in which a guide formation extends from a free end of each socket-defining component.

17. The arrangement as claimed in claim 16, in which each socket-defining component has a substantially rectangular, internal transverse profile with internal dimensions complementary to the free end of its associated prong.

18. The arrangement as claimed in claim 14, in which a wall of each socket defining component has at least one aperture defined therein to enable injection moulding without sliding core members.

19. The arrangement as claimed in claim 1, in which the base member is adhered to the inner surface of the folder.

20. The arrangement as claimed in claim 1, in which the base member is mechanically fastened to the inner surface of the folder.

21. The arrangement as claimed in claim 20, in which the base member is rivetted to the folder.

22. A filing accessory which includes a base member;

a fastening means which is arranged on the base member for fastening the base member to an inner surface of a folder;

a pair of flexible elongate elements arranged on, and extending from, the base member; and a pair of engaging members, one of each engaging member being arranged on a free end of each elongate element and being releasably engageable with an end of a filing prong.

23. The filing accessory as claimed in claim 22, in which the fastening means includes an adhesive layer arranged on the base member to permit the base member to be adhered to the inner surface of the folder.

24. The filing accessory as claimed in claim 22, in which the fastening means includes a mechanical fastening arrangement positioned on the base member to permit the base member to be mechanically fastened to the folder.

25. A folder for a filing arrangement, the folder including a front cover;

a back cover;

a pair of filing prongs extending from an inner surface of one of the covers; and a fastening means arranged on an inner surface of one of the covers, for fastening a base member of a filing accessory having a pair of flexible elongate elements arranged on, and extending from, the base member, to the inner surface of said one of the covers, the fastening means and the prongs being positioned relative to each other so that an engaging member arranged on a free end of each elongate element is releasably engageable with an end of each filing prong to retain the elongate elements in a configuration in which transfer of sheets from the filing prongs onto the elongate elements is facilitated.

26. The folder as claimed in claim 25, in which the fastening means is in the form of a layer of adhesive arranged on the inner surface of one of the covers so that the base member can be adhered to the inner surface of said one of the covers.

27. The folder as claimed in claim 26, in which a cover strip is arranged on the layer of adhesive to be removed by a user prior to use.

28. A filing arrangement which includes a folder;

a pair of filing prongs which are fixed to the folder to be received through openings defined in sheets to be filed in the folder;

a base member;

a retaining means which is arranged on the base member for retaining the base member in an operative position relative to the prongs;

a pair of flexible, elongate elements which are arranged on the base member; and a pair of engaging members, an engaging member being arranged on a free end of each elongate element and being engageable with a free end of each prong, the elongate elements being configured so that, when the engaging members are engaged with the prongs, the elongate elements are in a configuration in which transfer of the sheets from the prongs on to the elongate elements is facilitated.

29. The arrangement as claimed in claim 28, in which the retaining means includes at least one clipping formation which is shaped to clip on to the prongs.

30. The arrangement as claimed in claim 29, in which the retaining means includes a pair of clipping formations which are shaped so that a clipping formation can be clipped to each prong.

31. The arrangement as claimed in claim 28, in which the base member, the elongate elements and the engaging members are of a plastics material.

32. The arrangement as claimed in claim 28, in which the elongate elements are arranged on the base member to be displaceable with respect to the base member between a first position in which the elongate elements are substantially perpendicular to an inner surface of the folder and a second position in which the elongate elements are substantially parallel to the inner surface of the folder.

33. The arrangement as claimed in claim 32, in which the elongate elements are arranged on the base member to be pivotal with respect to the base member between the first and second positions.

34. The arrangement as claimed in claim 33, in which a living hinge is defined between each elongate element and the base member.

35. The arrangement as claimed in claim 34, in which the living hinges are configured so that the elongate elements are biased into their second position.

36. The arrangement as claimed in claim 28, in which the base member and the elongate elements are discrete components.

37. The arrangement as claimed in claim 36, in which an attachment means is arranged on the base member and the elongate elements to permit the elongate elements to be releasably attached to the base member.

38. The arrangement as claimed in claim 28, in which the base member and the elongate elements are of a unitary, one-piece construction.

39. The arrangement as claimed in claim 38, in which the base member and the elongate elements are a one-piece moulding.

40. The arrangement as claimed in claim 28, in which each engaging member is a socket-defining component which defines a socket which is dimensioned so that the free end of an associated prong can be received therein.

41. The arrangement as claimed in claim 40, in which each socket-defining component has a substantially rectangular, external transverse profile.

42. The arrangement as claimed in claim 40, in which a guide formation extends from a free end of each socket-defining component.

43. The arrangement as claimed in claim 40, in which each socket-defining component has a substantially rectangular, internal transverse profile with internal dimensions complementary to the free end of its associated prong.

44. A filing accessory which includes a base member;

a retaining means which is arranged on the base member for retaining the base member in an operative position relative to a pair of prongs extending from an inner surface of a folder;

a pair of flexible, elongate elements which are arranged on the base member; and a pair of engaging members, an engaging member being arranged on a free end of each elongate element and being engageable with a free end of each prong, the elongate elements being configured so that the elongate elements can be retained in an arch-like configuration.

* * * * *

UNITED STATES PATENT AND TRADEMARK OFFICE

CERTIFICATE OF CORRECTION

PATENT NO. : 6,129,475
DATED : October 10, 2000
INVENTOR(S) : Eric R. De Beer; Klaus P.S. Mathias It is certified that error appears in the above-identified patent and that said Letters Patent is hereby corrected as shown below:

Column 3,
Line 1, "cove r strip" should read -- cover strip --.
Line 30, "element s may" should read -- elements may --.

Column 4,
Line 22, "socketde-fining" should read -- socket-defining --.

Column 5,
Line 42, "900" should read -- 90° --.

Signed and Sealed this

Sixteenth Day of October, 2001

*Attest:*

Nicholas P. Godici

*Attesting Officer*

NICHOLAS P. GODICI
*Acting Director of the United States Patent and Trademark Office*